United States Patent [19]

Gabler

[11] 4,269,520

[45] May 26, 1981

[54] CARTRIDGE FOR DYE-IMPREGNATED ENDLESS RIBBON

[75] Inventor: Gerhard Gabler, Zurich, Switzerland

[73] Assignee: Precisa AG Rechenmaschinenfabrik, Zurich, Switzerland

[21] Appl. No.: 973,094

[22] Filed: Dec. 26, 1978

[51] Int. Cl.[3] ..... B41J 32/00

[52] U.S. Cl. ..... 400/196; 400/196.1

[58] Field of Search ..... 400/196.1, 196, 194

[56] References Cited

U.S. PATENT DOCUMENTS

| | | | |
|---|---|---|---|
| 3,830,351 | 8/1974 | Cappotto | 400/196 X |
| 3,871,507 | 3/1975 | Perry et al. | 400/196.1 X |
| 3,967,790 | 7/1976 | Hess | 400/196 X |
| 3,974,906 | 8/1976 | Lee et al. | 400/196.1 |
| 3,994,383 | 11/1976 | Best | 400/196.1 |
| 4,092,921 | 6/1978 | Mcinnis et al. | 400/196.1 |
| 4,130,367 | 12/1978 | Guerrini et al. | 400/196 X |

FOREIGN PATENT DOCUMENTS

| | | | |
|---|---|---|---|
| 2108742 | 9/1972 | Fed. Rep. of Germany | 400/196.1 |
| 2260663 | 7/1973 | Fed. Rep. of Germany | 400/196.1 |
| 2652109 | 5/1978 | Fed. Rep. of Germany | 400/196.1 |
| 2732030 | 1/1979 | Fed. Rep. of Germany | 400/196.1 |
| 2332136 | 7/1977 | France | 400/196.1 |
| 7706427 | 6/1977 | Netherlands | 400/196.1 |
| 29235 | of 1913 | United Kingdom | 400/196.1 |

OTHER PUBLICATIONS

IBM Tech. Disc. Bulletin, "Ribbon Cartridge," vol. 17, No. 4, Sep. 1974, pp. 1118–1119.

*Primary Examiner*—E. H. Eickholt

*Attorney, Agent, or Firm*—Ernest F. Marmorek

[57] ABSTRACT

A cartridge for a dye-impregnated endless ribbon includes a transport device disposed within the cartridge; the transport device includes a driving member having a surface, and a stationary member having another surface so that the surfaces define a passage for the ribbon. Friction-generating devices are disposed near the surface of at least one member and in contact with the ribbon, causing the ribbon to move only in one direction through the passage. A drive device is provided and may be operated to move the driving member with respect to the stationary member.

17 Claims, 10 Drawing Figures

CARTRIDGE FOR DYE-IMPREGNATED ENDLESS RIBBON

BACKGROUND OF THE INVENTION

In modern typewriters it is preferred to use endless ribbons, in which the ribbon is stored within a storage space in loose and irregular windings. A cartridge of this type includes a mechanism, serving for transport of the ribbon from the storage space of the cartridge to the printing mechanism of the typewriter, and for again returning the ribbon to the storage space. The ribbon is guided towards the printing mechanism by guide arms; the transport of the ribbon is accomplished intermittently, and is thus devoid of any uniform motion. Cartridges known for endless ribbons have a number of disadvantages as far as the transport devices are concerned, which are built into the cartridge. According to the presently known solutions the drive mechanism of the typewriter must perform a pivotal movement, which furthermore has to be performed within a specified plane. This requires additional construction elements such as bearings, axles, gear wheels, push rods, etc., the construction thus becoming cumbersome and costly. Furthermore the transport device within the cartridge requires a large number of components, which in turn increase the cost of the cartridge and complicate its construction.

SUMMARY OF THE INVENTION

It is therefore the object of the present invention to simplify cartridges for ribbons in endless tapes.

It is another object of the invention to utilize fewer constructional parts than have been utilized hitherto, and to simplify the drive means.

These objects are achieved, according to the present invention, by providing a cartridge for a dye-impregnated endless ribbon, which includes transport means disposed within the cartridge, the transport means including a driving member having a surface, and a stationary member having a surface, the surfaces defining a passage for the ribbon. Additionally, friction-generating means are disposed near the surface of at least one of the members, and in contact with the ribbon, causing the ribbon to move only in one direction through the passage, and drive means are provided which are operable to move the driving member with respect to the stationary member.

The drive means may preferably be moved reciprocally through a prearranged stroke, so as to drive the ribbon through a predetermined distance during each alternate stroke.

It is advantageous if at least one of the members offers no resistance in one direction, but resists movement of the ribbon in the opposite direction.

It is further advantageous if the cartridge includes storage means, and if the ribbon is stored loosely in the storage means; furthermore, the drive means can preferably be operated intermittently.

The storage means preferably include guide means for the ribbon; the friction-generating means may be bristles, fibers, lamellae, scales, or the like.

The friction-generating means are preferably disposed also at least near the surface of the other member, the friction-generating means of each member facing one another.

The friction-generating means, such as, for example, bristles, may be of substantially equal size, or, in the example discussed, at least some bristles may differ in size from other bristles.

The driving member is preferably movable relative to the stationary member along the passage.

It is advantageous if the ribbon includes at least two different longitudinal zones of respective predetermined widths, each zone being impregnated with a different dye, and if the friction-generating means are disposed also on the surface of the other member, the group of friction-generating means of a corresponding member extending over a width slightly smaller than the width of a corresponding zone.

It is further advantageous if the cartridge includes brake means for applying a braking force to the ribbon, the brake means being preferably disposed on the guide means.

The guide means in turn include two guide arms, one guide arm being disposed upstream of the transport means, the other guide arm being disposed downstream therefrom; the brake means is preferably disposed in the guide downstream from the transport means.

In one version of the invention, the driving member is reciprocally movable.

In another version of the invention, the driving member includes a ratchet mechanism, which may be engaged by the drive means for rotating the driving member only unidirectionally.

It is advantageous if the drive means are adapted to be coupled to a printing mechanism for the rotation of the ratchet mechanism as commanded by the printing mechanism, the drive means preferably including resilient means in engagement with the ratchet mechanism.

It is further advantageous if the ratchet mechanism includes two outer portions, and if the periphery of at least one of the portions is zig-zag shaped; a groove is advantageously defined between the outer portions, and an arm is provided for making contact with the groove.

It is advantageous if resilient means are disposed near the stationary member for urging it towards the driving member; the resilient means are preferably constituted by a leaf spring. The periphery of the ratchet mechanism is advantageously depressible.

BRIEF DESCRIPTION OF THE DRAWINGS

The invention will be best understood from the accompanying drawings, in which.

DESCRIPTION OF THE PREFERRED EMBODIMENTS

Figure 1:
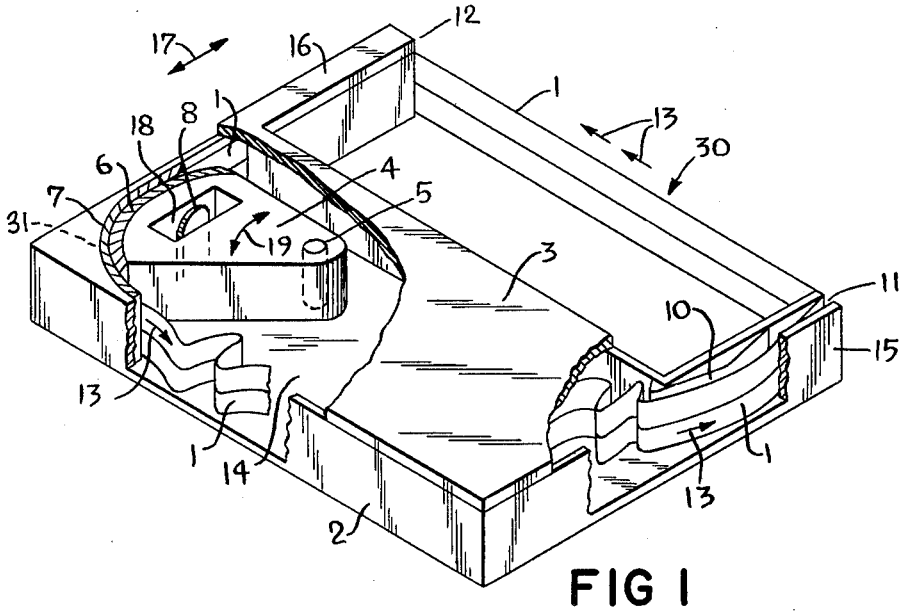
FIG. 1 shows a perspective view of a first basic embodiment of the invention.

Referring now to the drawing, and particularly to FIGS. 1 through 5 of the first basic embodiment of the invention, it will be seen that a cartridge 30 includes a housing portion 2, and a corresponding cover 3, in which a ribbon 1 is stored loosely and in irregular shape. Within the cartridge 30 there is provided a storage chamber 14, in which there are disposed guide arms 15 and 16 for guiding the ribbon 1. The ribbon is transported through slots 11 and 12 in respective guide arms 15 and 16 to the printing mechanism of a typewriter, or the like, and is returned therefrom to the storage chamber 14, in the direction of the arrows 13. The transport mechanism is set in motion by means of a reciprocally and intermittently operable drive element 8, movable through a prearranged stroke, the drive element 8 being adapted to be coupled to the printing mechanism of a typewriter or the like, and may take the form of a push-rod, lever, linkage, or the like. This drive element 8 is reciprocally movable within a recess 18 of one ribbon-engaging member 4, along the direction of an arrow 17, which points in opposite directions, the ribbon-engaging or driving member 4, and the drive element 8, together constituting the drive means for the ribbon 1; the driving member 4 is pivotable about a shaft 5 rigid with the housing portion 2.

A ribbon-contacting surface of the pivotable ribbon-engaging, or driving member 4, and an inner surface 31 of the housing portion 2, constituting a stationary member, is clad with respective sets of friction-generating devices 6 and 7, which may consist of bristles, fibers, lamellae, scales or the like. These friction-generating devices 6 and 7 are oriented and structured substantially parallel to one another on the same surface, and face each other on opposite respective surfaces, so that they can take along the ribbon 1 in only one direction of motion of the ribbon-engaging or driving member 4; only a sliding motion occurs, however, on the return stroke of the driving member 4 without any accompanying friction, so that the ribbon 1 is not moved along therewith, but is driven forward through a predetermined distance during each alternate stroke. It will therefore be appreciated that a passage is formed between the friction-generating devices 6 and 7, and that the driving member 4 may move relative to the stationary member 2, along that passage.

FIGS. 2, 3, 4 and 5 show different versions of the first basic inventive embodiment of the cartridge.

Figure 2:
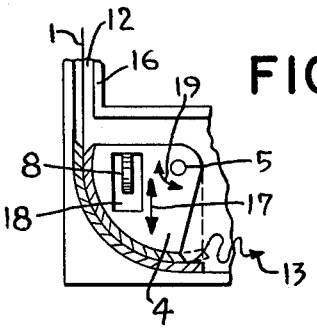
FIG. 2 shows a detail of a partial cross-section of a first version of the cartridge, according to the first basic inventive embodiment.

In FIG. 2, the driving member 4 moves in opposite directions about the pivoting axle 5 in the direction of the arrow 19, if the drive element 8 is reciprocally moved within the recess 18 of the driving member 4 by the printing mechanism of the typewriter. The resulting direction of motion of the ribbon 1 is shown by the arrow 13, which occurs in tht direction as a result of the previously described orientation of the groups of friction-generating means 6 and 7.

Figure 3:
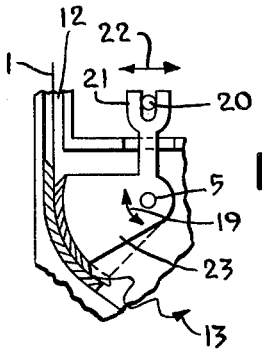
FIG. 3 shows a detail in partial cross-section of a second version of the cartridge, according to the first basic inventive embodiment.

FIG. 3 shows an alternate embodiment of the drive means. The drive means includes a bolt 20, which is surrounded by a U-shaped lever 21. The bolt 20 moves reciprocally along the respective opposite directions of the arrow 22, and consequently pivots a drive member 23 about a pivot axle 5. The ribbon 1 is moved in a fashion similar to that of FIG. 2.

Figure 4:
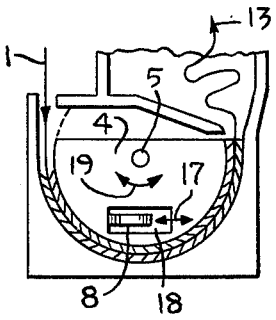
FIG. 4 shows a detail in partial cross-section of a third version of the cartridge, according to the first basic embodiment.

FIG. 4 merely shows that the drive means may be shaped differently within the cartridge 30, and may, for example, be shaped in the form of a semicircle.

Figure 5:
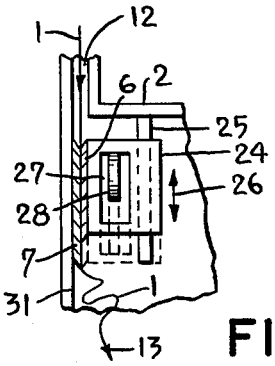
FIG. 5 shows a detail in partial cross-section of a fourth version of the cartridge, according to the first basic inventive embodiment.

FIG. 5 shows an embodiment where the friction-generating means 6 and 7 may be moved relative to one another along a straight line, or plane, in distinction to the arcuate movements of similar friction-generating means shown in FIGS. 2 through 4. In FIG. 5, the drivin element 24 is movable along a shaft 25 in respective opposite directions of the arrow 26, by means of a bolt 28, the driving member 24 having a recess 27 for the reciprocal movement of the bolt 28. The ribbon is transported in a manner similar to that shown in the remaining figures, the difference being merely that the ribbon is moved along a straight line.

The recesses 18 and 27, shown in FIGS. 1 and 5, respectively, are preferably dimensioned so as to exceed the width of the respective driving elements 8 and 27. This permits the attainment of a relatively long stroke, and a relatively smooth advancement of the ribbon 1.

A second basic embodiment of the invention is shown in FIGS. 6 through 10. Only that portion of the cartridge is shown, in which the ribbon is transported. A cartidge 30′ is provided with a guide arm 16′ and has a storage chamber 14′, through which the ribbon 1′ may be moved in the direction of the arrows A. The ribbon 1′ is transported with the aid of the friction- or ratchet mechanism which includes in accordance with a preferred embodiment a single unitary or single substantially rigid driven member 4′ in the direction of the arrow B. The friction- or ratchet mechanism 4′ is in turn driven intermittently with the aid of a drive member or engaging member or driving element 8′, which is urged towards the ratchet mechanism or wheel 4′ by means of a (non-illustrated) spring disposed below the plane of the paper, the movement of the driving element 42′ being bounded by the dimensions of the recess 32′, and in turn resulting in a step-wise advance of the ratchet wheel 4′. The ribbon 1′ is therefore moved with respect to the single unitary stationary member, namely the leaf spring 10′, which exerts pressure on the operationally effective surfaces of the friction- and/or ratchet wheel 4′.

Figure 6:
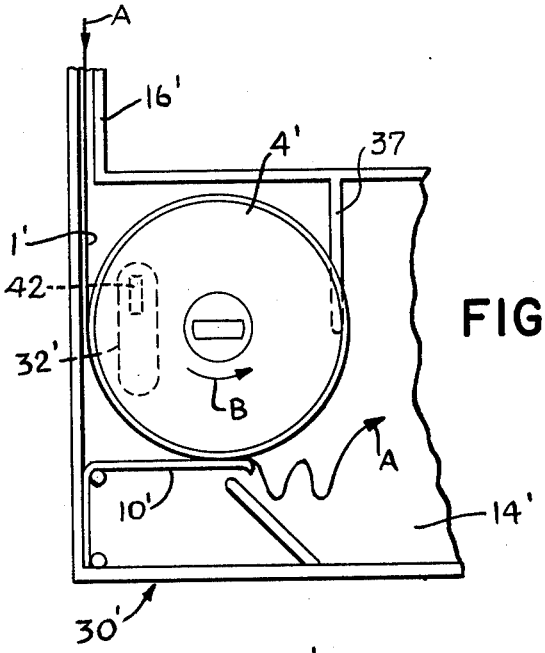
FIG. 6 shows a plan view of a second basic embodiment of the invention.
Figure 7:
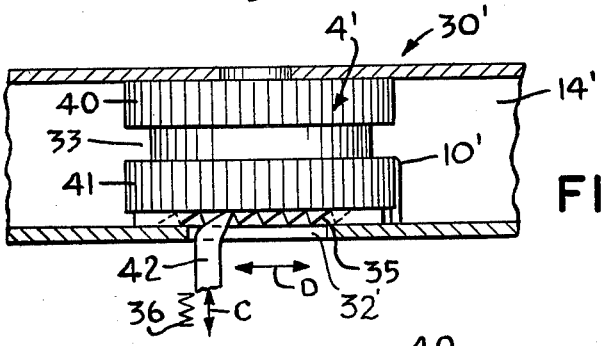
FIG. 7 shows a detail in side-view of the ratchet mechanism of the second basic inventive embodiment.

FIG. 7 shows an enlarged detail of FIG. 6, in side view. It will be seen that the friction- or ratchet wheel or mechanism 4′ includes outer zig-zag shaped portions 40 and 41, and a center portion 33, which may have the form of a groove. The width of the outer portions 40 and 41 is generally smaller than the width of corresponding longitudinal zones of a ribbon having two regions or zones impregnated with different respective dyes. The lower outer portion 41 has saw-tooth shaped teeth 35, which are adapted to be engaged by drive member 42. The drive member 42 is urged upwardly towards the saw-tooth shaped teeth 35 by means of a spring 36, along the direction of the arrow C. The spring 36 may also take the form of a leaf spring. The engaging member 42 travels along the dual arrow D pointing in opposite directions, so as to take the friction- or ratchet wheel 4′ along in a transport direction, while the member 42 is disengaged from the saw-tooth shaped portion on its return stroke.

Figure 8:
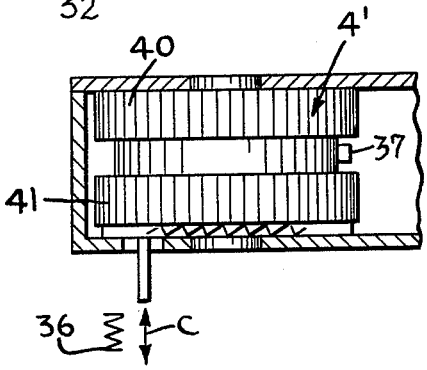
FIG. 8 shows the ratchet mechanism of FIG. 7, including an arm for making contact with a groove of the ratchet mechanism, according to the second basic inventive embodiment.

FIG. 8 shows a side view of FIG. 7, an arm 37 for making contact with the groove or center portion of the ratchet wheel being recognizable.

Figure 9:
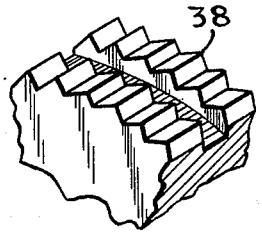
FIG. 9 shows a perspective view of a peripheral portion of the ratchet mechanism, according to the second basic inventive embodiment.
Figure 10:
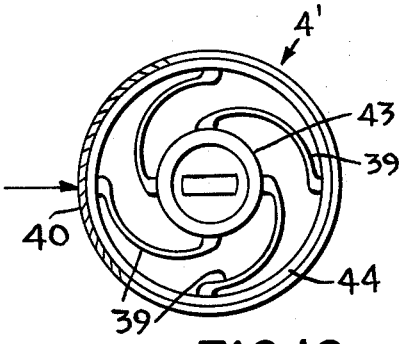
FIG. 10 shows an elevational view of the ratchet mechanism of the second basic inventive embodiment, illustrating how the ratchet is depressible.

FIG. 9 shows the zig-zag nature of the friction- or ratchet wheel 4', while a version of the ratchet wheel 4' shown in FIG. 10 is implemented to be resiliently depressible, due to the presence of curved leaf springs 39 extending between a shaft 43 and a peripheral portion 44, which feature increases the friction- and transport effect even further.

In the event of usage of a friction wheel or ratchet mechanism 4', it is possible to mount a layer of elastic material having a high coefficient of friction on the periphery of the ratchet mechanism 4'. The driving member 4' may alternately be entirely made up of elastic material.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A cartridge including a housing for storing an endless dye-carrying ribbon in several locations in said housing, and for operatively withdrawing successive portions therefrom, said portions being arranged to be advanced in a predetermined direction from a first location to a fourth location downstream of said first location, comprising in combination:

ribbon conduit means located at a second location downstream of said first location for returning and guiding the successive ribbon portions into said housing, a single unitary resilient stationary member, secured inside said housing, a single substantially rigid driven member arranged in said housing, operable to be advanced in said predetermined direction, and including two outer parts, at least one of said outer parts having a set of teeth along the periphery of said driven member, said teeth in cooperation with said stationary member engaging successive portions of said ribbon, a groove being defined between said outer parts, said members being located at a third location downstream of said second location and disposed between said second and fourth locations, said stationary member resiliently pressing said ribbon into engagement with said teeth, and an arm reaching into said groove to make contact therewith.

2. A cartridge as claimed in claim 1, wherein said drive means is reciprocally movable through a prearranged stroke, so as to drive said ribbon through a predetermined distance during each alternate stroke.

3. A cartridge according to claim 1, including storage means, and wherein at least a major portion of said ribbon is stored loosely in said storage means.

4. A cartridge according to claim 3, wherein said storage means include guide means for said ribbon.

5. A cartridge according to claim 1, wheein said driving member includes a ratchet mechanism for rotating the driving member so as to obtain a resultant unidirectional motion.

6. A cartridge according to claim 5, wherein said drive means are adapted to be coupled to a printing mechanism, and further comprising resilient engagement means for engaging said ratchet mechanism, and adapted to be coupled to said printing mechanism for a resultant unidirectional rotation of said driven member as commanded by said printing mechanism.

7. A cartridge according to claim 5, wherein said friction-generating means comprise a layer of elastic material mounted on the periphery of said driven member, the layer material having a high coefficient of friction.

8. A cartridge according to claim 5, wherein said driven member is composed of elastic material.

9. A cartridge as claimed in claim 5, wherein said ratchet mechanism further comprises a central portion and a plurality of leaf springs extending between said central portion and the periphery of said ratchet mechanism, whereby the periphery of said ratchet mechanism is depressible.

10. A cartridge as claimed in claim 1, wherein said resilient means is a leaf spring.

11. A cartridge as claimed in claim 1, wherein said driving member is adapted to be driven by drive means.

12. A cartridge according to claim 11, wherein said drive means are intermittently operable.

13. A cartridge according to claim 11, wherein said drive means are coupled to a printing mechanism and to transport means for transporting said ribbon towards said printing mechanism.

14. A cartridge as claimed in claim 1, wherein at least a part of said ribbon is tensionable from a normally occupied slack position, and wherein said one member is further moveable in a direction opposite to said predetermined direction, and cooperates with said ribbon conduit means, so that upon the movement of said one member in said opposite direction, said portion, due to any lack of tension being applied thereacross, is restrained from moving through said ribbon conduit means in said opposite direction.

15. A cartridge as claimed in claim 1, wherein both outer parts have a set of teeth, said teeth being zig-zag shaped.

16. A cartridge as claimed in claim 1, further including a bottom portion having an opening adapted to receive drive means for driving the driven member.

17. A cartridge as claimed in claim 1, wherein said arm is integral with said housing.

* * * * *